US006401677B1

(12) United States Patent
Rohe et al.

(10) Patent No.: US 6,401,677 B1
(45) Date of Patent: Jun. 11, 2002

(54) CAM ROCKER VARIABLE VALVE TRAIN DEVICE

(75) Inventors: Jeffrey D. Rohe, Caledonia; Ronald J. Pierik, Rochester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/784,506

(22) Filed: Feb. 15, 2001

Related U.S. Application Data

(60) Provisional application No. 60/183,123, filed on Feb. 17, 2000.

(51) Int. Cl.[7] ..... F01L 13/00

(52) U.S. Cl. ..... 123/90.16; 123/90.17; 123/90.65

(58) Field of Search ..... 123/90.15, 90.16, 123/90.17, 90.22, 90.31, 90.39, 90.6, 90.65

(56) References Cited

U.S. PATENT DOCUMENTS 5,937,809 A * 8/1999 Pierik et al. ..... 123/90.16
5,996,540 A * 12/1999 Hara ..... 123/90.16
6,019,076 A * 2/2000 Pierik et al. ..... 123/90.16
6,295,958 B2 * 10/2001 Pierik ..... 123/90.16
6,311,659 B1 * 11/2001 Pierik ..... 123/90.24

* cited by examiner

*Primary Examiner*—Weilun Lo
(74) *Attorney, Agent, or Firm*—John VanOphem

(57) ABSTRACT

A variable valve train device for installation in an internal combustion engine to controllably vary the intake valve lift, open duration, and timing. A rotary camshaft has a cam lobe for rotation in timed relationship to the motion of the pistons of the engine. A close-fitting frame is rotationally disposed on the camshaft and is pivotably connected to a control shaft such that the angular orientation of the frame may be controlled with respect to the camshaft. A rocker arm disposed on the frame is provided with an input roller which follows the lobe of the camshaft to oscillate an output roller in response to rotary motion of the cam. The output roller drives an output cam which cooperates with a cam follower to open an engine intake valve conventionally against a valve spring. A curved return spring disposed between the output cam and the frame returns the output cam as the valve closes. Rotation of the frame about the camshaft alters the timing of the valve opening, the height of the valve lift, and the duration of opening. The invention is capable of controlling engine load and peak engine torque directly at the cylinder head without resort to a conventional throttle.

9 Claims, 6 Drawing Sheets

CAM ROCKER VARIABLE VALVE TRAIN DEVICE

CROSS REFERENCE TO RELATED APPLICATION

This application claims the benefit of U.S. Provisional Application No. 60/183,123 filed Feb. 17, 2000.

TECHNICAL FIELD

The present invention is related to variable valve train systems for use on internal combustion engines; more particularly, to devices for controllably varying the lift of valves in such engines; and most particularly, to a cam rocker (CR) variable valve train device that enables engine load control without a conventional throttle by varying the lift of the intake valves, the open valve duration, and the phasing of valve events relative to the motion of the engine's pistons.

BACKGROUND OF THE INVENTION

Internal combustion engine performance has progressed considerably in the past century. Inventions have yielded cleaner exhaust and enhanced durability, fuel efficiency, and power. Systems for varying the lift and timing of intake valves can further refine and enhance the performance of the internal combustion engine by controllably varying the volume of fuel mix supplied to the combustion chambers as a function of engine load and rotational speed. Fuel economy at part load operation can be increased by promoting more thorough combustion, reducing pumping work done by the pistons, which saps energy, deactivating cylinders, and/or by implementing a lean air/fuel ratio scheme. Matching the intake valve closing time more closely to the engine's needs can enhance driveability of a vehicle by improving engine breathing at full engine load. Moreover, if intake and exhaust events can be controlled sufficiently to vary engine load, speed, and fuel dilution over the entire spectrum of required engine operating conditions, a controllable variable valve train can obviate the need for a throttle valve and EGR valve in a gas or diesel internal combustion engine.

A range of variable valve train devices and valve timing mechanisms for enhancing engine performance are known in the automotive art, but commercial use of such devices generally has been impractical because of cost, size, and/or operating limitations which have limited their true value and practicality. For example, a variable valve timing (VVT) mechanism as disclosed in U.S. Pat. No. 5,937,809 issued Aug. 17, 1999 to Pierik et al., employs a segmented single shaft crank rocker (SSCR) for operating individual or multiple engine valves by engaging a linkage with a rotary eccentric, preferably a rotary cam, to drive an oscillatable rocker cam. The SSCR mechanism disclosed in Pierik et al. has four moving components and thus can be expensive to manufacture and subject to wear and premature failure at a plurality of joints.

It is a principal object of the present invention to provide total authority over intake valve lift, open valve duration, and phasing of intake and exhaust events relative to the motion of an engine's pistons.

It is a further object of the invention to improve peak engine torque and fuel economy.

It is a still further object of the invention to controllably vary the engine load directly at the engine cylinder, thereby eliminating the need for prior art throttle body and idle air control devices.

It is a still further object of the invention to reduce the size and number of components of the device in comparison with prior art variable valve train devices.

It is a still further object of the invention to provide a variable valve train device which can be economically mass-produced for commercial use in vehicles powered by internal combustion engines.

SUMMARY OF THE INVENTION

Briefly described, a cam rocker (CR) variable valve train device in accordance with the invention is provided for installation on an internal combustion engine having a rotary camshaft and a cam lobe fixed thereupon for rotation in timed relationship to the motion of the pistons of the engine. A close-fitting frame is rotationally disposed on the camshaft such that the camshaft is free to rotate within the frame. The frame is pivotably connected to an auxiliary control shaft such that the angular orientation of the frame may be controlled with respect to the camshaft. A rocker arm is pivotably disposed on the frame and is provided with an input roller which follows the lobe of the camshaft to correspondingly oscillate an output roller at the output end of the rocker in response to rotary motion of the cam. The output roller drives a cam spring cup rotatably disposed on the camshaft and attached to an output cam which cooperates with a cam follower to actuate the stem of an engine intake valve to open the valve conventionally against a valve spring. A curved return spring disposed between the spring cup and the frame is compressed by the valve-opening motion of the output cam and serves to return the cam to permit the valve to close. In a preferred embodiment for controlling the motion of two parallel valves at a single engine cylinder, the elements of the frame, cam spring cup, output cam, and spring are doubled symmetrically about the camshaft lobe and the rocker arm, the output roller cooperating with a bridge element connecting the two cam spring cups for simultaneous and identical actuation thereof. Rotation of the frame about the camshaft serves to alter the timing of the valve opening with respect to the associated piston, the height of the valve lift, and the duration of opening. Preferably, each cylinder in an internal combustion engine is provided with an apparatus in accordance with the present invention. The disclosed invention is thus capable of controlling engine load and peak engine torque directly at the cylinder head without resort to a conventional throttle and exhaust gas recirculation (EGR) valve.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
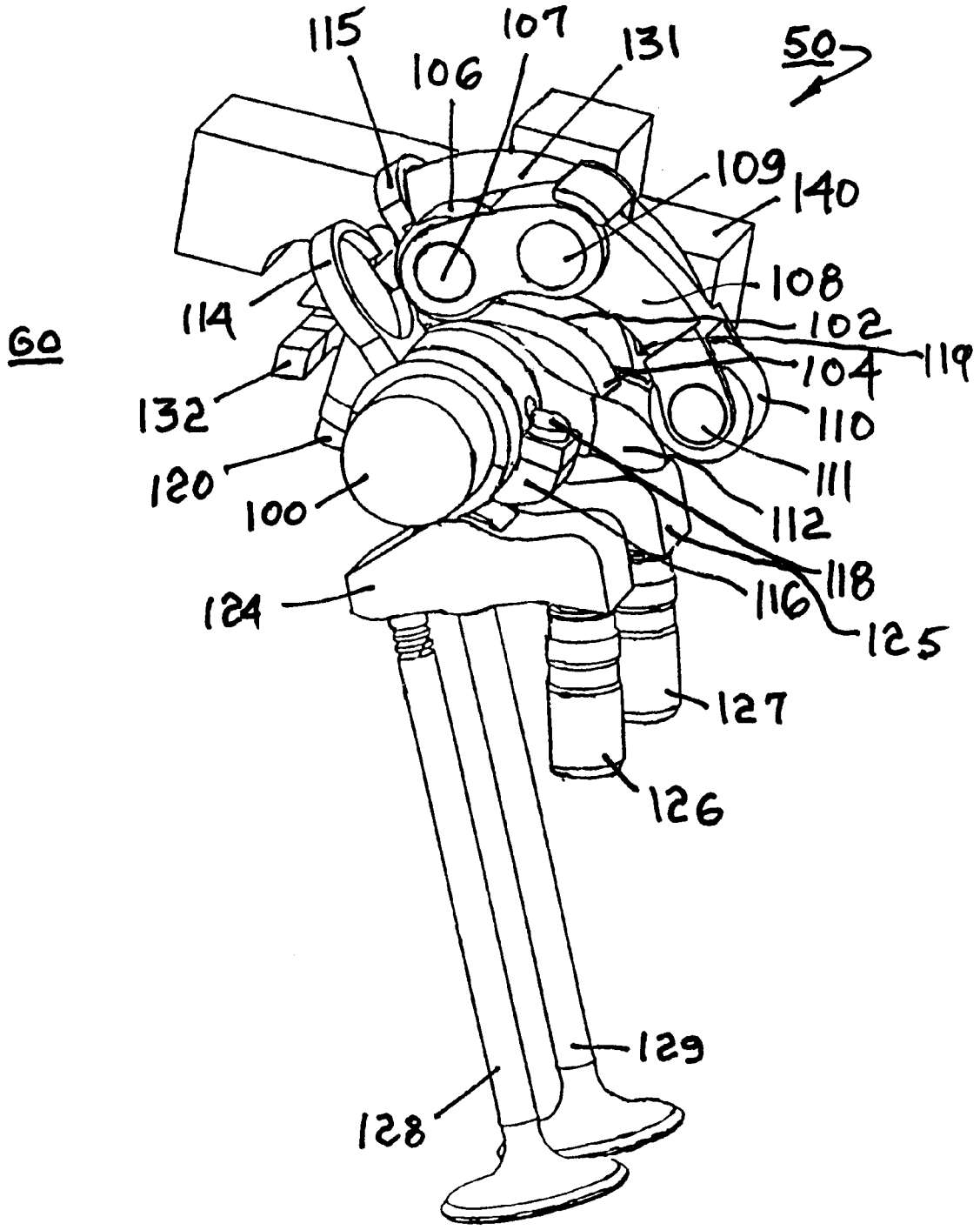
FIG. 1 is an isometric front view of an exemplary embodiment of a CR variable valve train device in accordance with the present invention, showing the start of an intake event, in the full load frame position with certain elements removed for clarity.

Referring to FIGS. 1 through 6, numeral 60 generally indicates a portion of an internal combustion engine including a first exemplary embodiment of a CR variable valve train device 50 operative to actuate dual inlet valves for a single cylinder of an internal combustion engine. (Note that in FIGS. 1,2,5, and 6, various parts have been omitted for purposes of clarity.) Device 50 includes a rotary valve-actuating input camshaft 100 which extends the length of a cylinder head (not shown) of, for example, a multi-cylinder internal combustion engine 60, of which the CR variable valve train device 50 is illustrated for only a single cylinder. The valve-actuating input camshaft 100 may be driven conventionally from the engine crankshaft as by a chain, belt, or other means (not shown) which would be suitable for driving a conventional valve-actuating camshaft. Camshaft 100 is referred to as being an "input" camshaft because, when used with a variable valve train device as described and claimed herein below, the camshaft does not directly open and close the intake valves as in a conventional engine, but rather provides input to the device which then uses that input to variably and controllably open the valves as may be desired.

Figure 2:
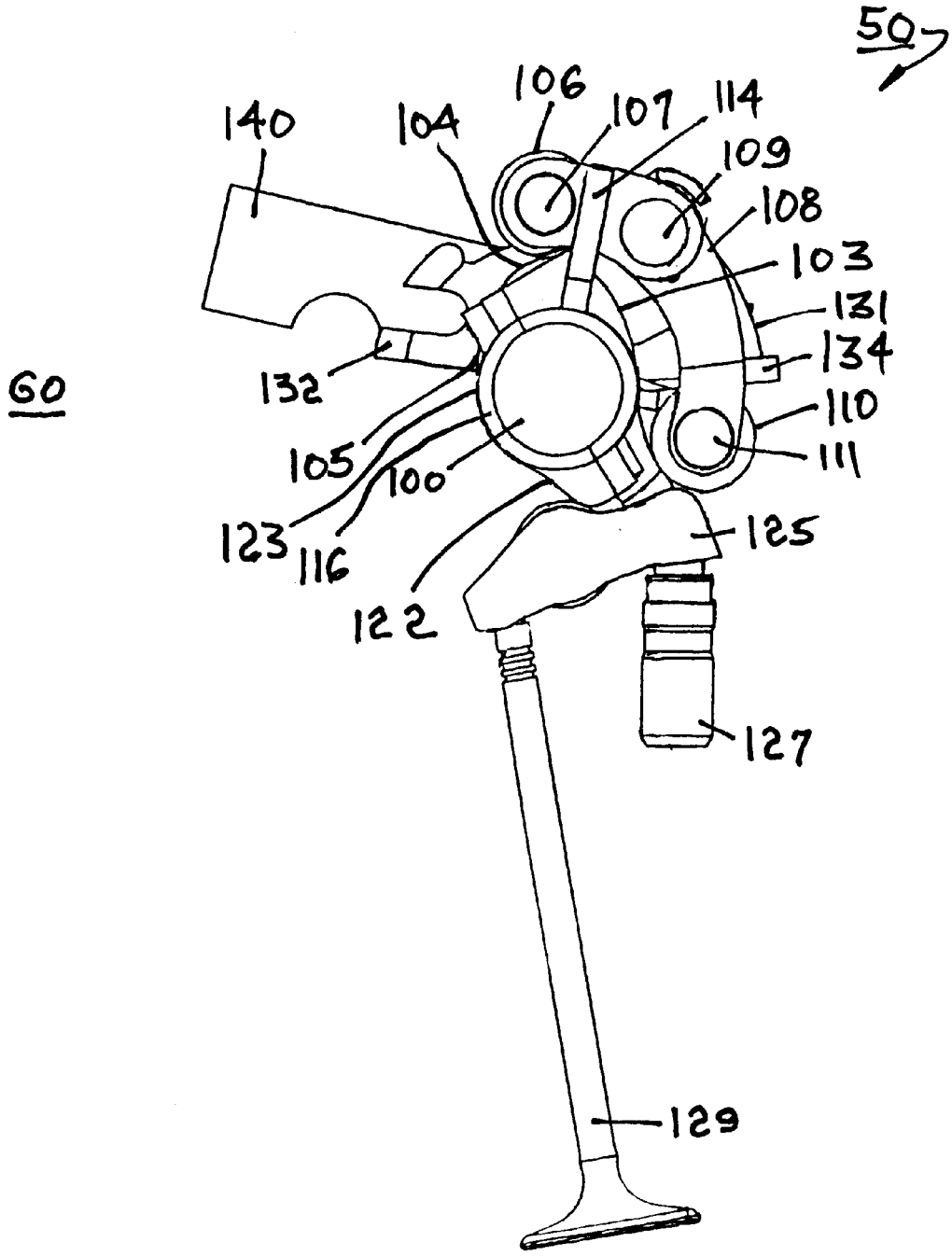
FIG. 2 is a side view similar to FIG. 1, with certain elements removed for clarity, but showing the peak or full valve lift of an intake event.

FIGS. 1,2,5, and 6 depict device 50 including a drop-in, one-piece frame 132 disposed on camshaft 100. Frame 132 is free to rotate about camshaft 100 in response to an actuating means (not shown) driven by a control shaft (not shown) which may be substantially parallel to camshaft 100, as fully disclosed in U.S. Pat. No. 6,019,076 issued Feb. 1, 2000 to Pierik et al., the relevant disclosure of which is herein incorporated by reference. Controlled rotation of frame 132 establishes the valve timing, valve lift, and engine load at any given engine operating condition. The full load orientation of frame 132 is shown in FIGS. 1 and 2; that is, when intake valves 128,129 are closed (FIG. 1) and then opened (FIG. 2) full lift of the valves of their respective seats and maximum open duration of the valves are obtained, corresponding to a full engine load condition.

Since the intake valve lift profiles may thus be tailored as desired to any given set of engine conditions, peak output is less of a compromise than on an engine with fixed valve timing and a throttle body. At any given engine speed, optimum performance is mainly a function of when the intake valve closes (IVC). At high piston speeds, both increased flow velocities and flow losses, along with increased air column momentum and wave effects in the intake system, produce a tendency for intake flow to continue beyond the bottom dead center (BDC) position of the piston. Therefore, power is optimized with an IVC well after BDC. At low speeds, flow velocity, flow loss, air column momentum and wave effects are reduced so that inflow ceases near BDC. A conventional engine with fixed timing and an IVC optimized for one high engine speed will suffer volumetric inefficiency at low speeds, due to flow reversion after BDC. Thus, a VVA equipped engine with an IVC optimized for peak power at the highest lift profile should advance IVC with decreasing rpm and lift.

Arcuate ends 135,136 of frame 132 ride in arcuate grooves 137,138, respectively, provided in camshaft bearing caps 139,140 to allow rotation of frame 132 with respect to the camshaft 100. By mounting frame 132 in bearing caps 139,140 and out of rotational contact with camshaft 100, friction and hence drag on the device during actuation are reduced. The rotation of frame 132 about the centerline of camshaft 100 causes rotation of the entire device 50 (except lash adjusters, roller finger followers, and valves as described hereinbelow), so that the lift, duration, and phase of the intake events may varied as desired in a controlled manner. Additionally, in FIGS. 1 and 2, the rotation of frame 132 counter-clockwise about camshaft 100 by way of ends 135,136 in grooves 137,138 reduces piston pumping work losses and thereby further improves fuel economy.

In the present embodiment, one-piece input camshaft 100 is driven clockwise as shown in FIGS. 1 and 2 conventionally at one-half the crankshaft rotational speed. Rocker arm 108 is rotatably attached to frame 132 by pin 109. Input roller 106 is rotatably attached by pin 107 to rocker arm 108 near a first end thereof for rolling engagement with input cam lobe 102 having opening flank 103 and nose 104. Output roller 110 is rotatably attached by pin 111 near a second and opposite end of rocker arm 108. As opening flank 103 and then nose 104 pass beneath input roller 106, rocker arm 108 is caused to rotate clockwise about pin 109, causing output roller 110 to push down on shaped bridge section 112 which is connected to first and second cam spring cups 114,115. The cam spring cups are disposed on opposite sides of input cam lobe 102 rotatably with respect to input camshaft 100, and bridge section 112 is positioned with respect to input camshaft 100 at a radial distance sufficient that lobe 102 may pass beneath bridge 112 during rotation of the input camshaft. Actuating bridge section 112 thus causes both cam spring cups to be rotated clockwise about input camshaft 100. Output cams 116,117 are attached to cam spring cups 114,115, respectively, as by cap screws 118,119,120, and 121. Clockwise rotation of rocker arm 108, and the associated clockwise rotation of cam spring cups 114,115, results in clockwise rotation of output cams 116, 117. Roller finger followers 124,125 are pivotably tethered to conventional stationary hydraulic lash adjusters 126,127, respectively, which lash adjusters may be mounted on the engine head in known fashion. Roller finger followers 124,125 are preferably provided with conventional ball socket ends (not shown) for receiving conventional ball ends (not shown) of the lash adjusters 126, 127. Followers 124,125 ride on output cams 116,117, respectively. As output cams 116,117 rotate clockwise, their respective profiled shapes 122 transmit a counter-clockwise motion into roller finger followers 124,125 located below them. Rotation of followers 124,125 about the pivot heads of the lash adjusters 126,127 creates lift at the two engine valves 128,129 positioned directly below followers 124,125.

Figure 4:
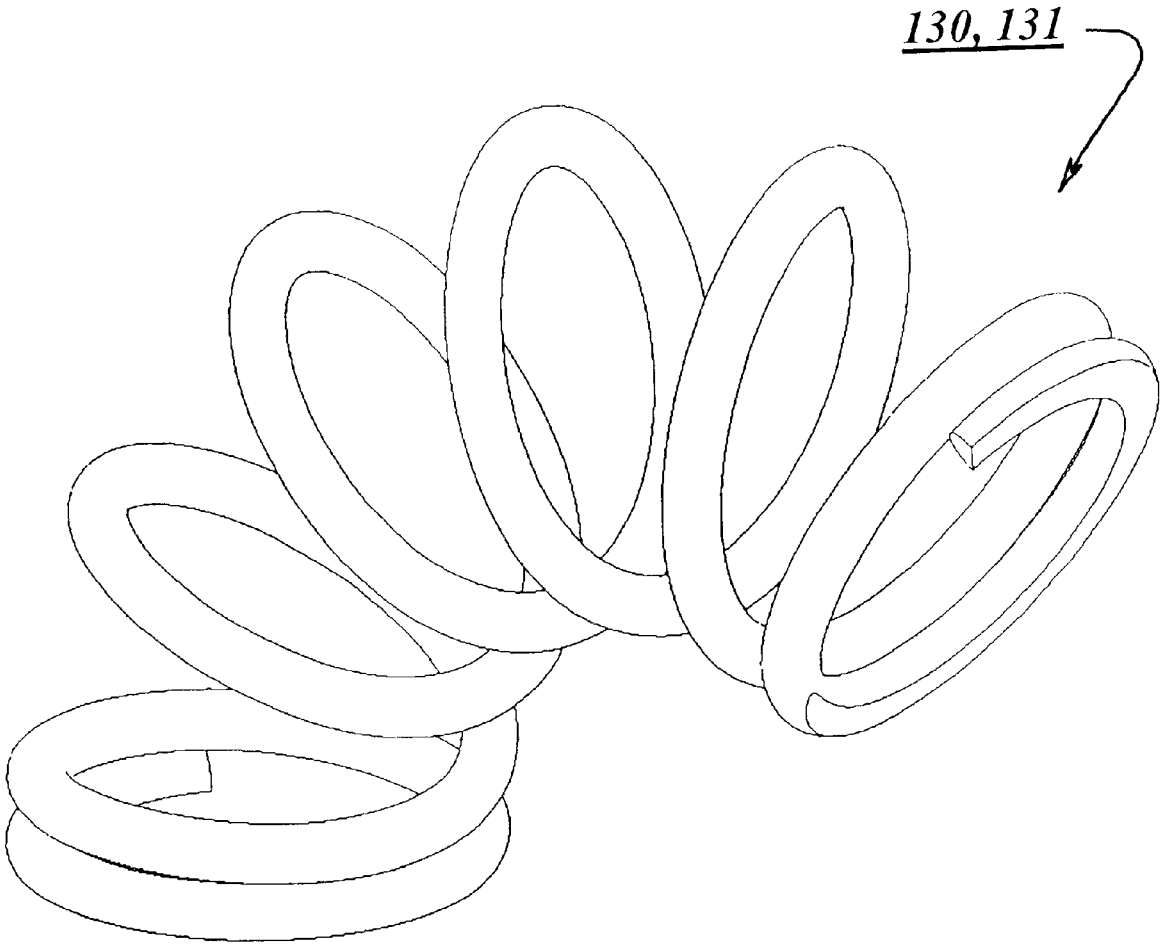
FIG. 4 is an isolated pictorial view of one of the two curved helical compression springs used in a QCR variable valve train device in accordance with the present invention.
Figure 5:
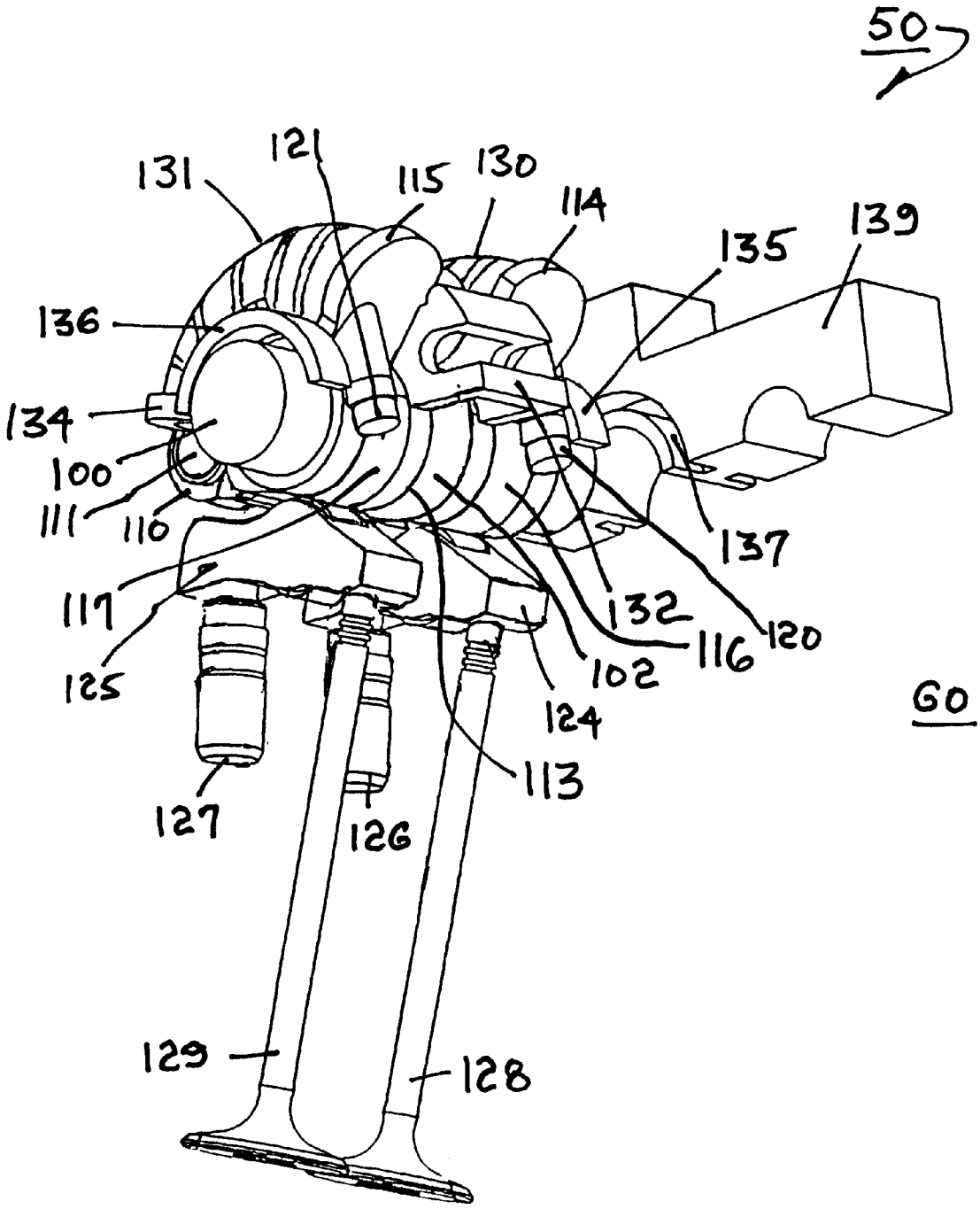
FIG. 5 is an isometric rear view from beneath the device, showing how the frame is pivotably mounted in the camshaft-bearing cap grooves of the camshaft bearing cap.
Figure 6:
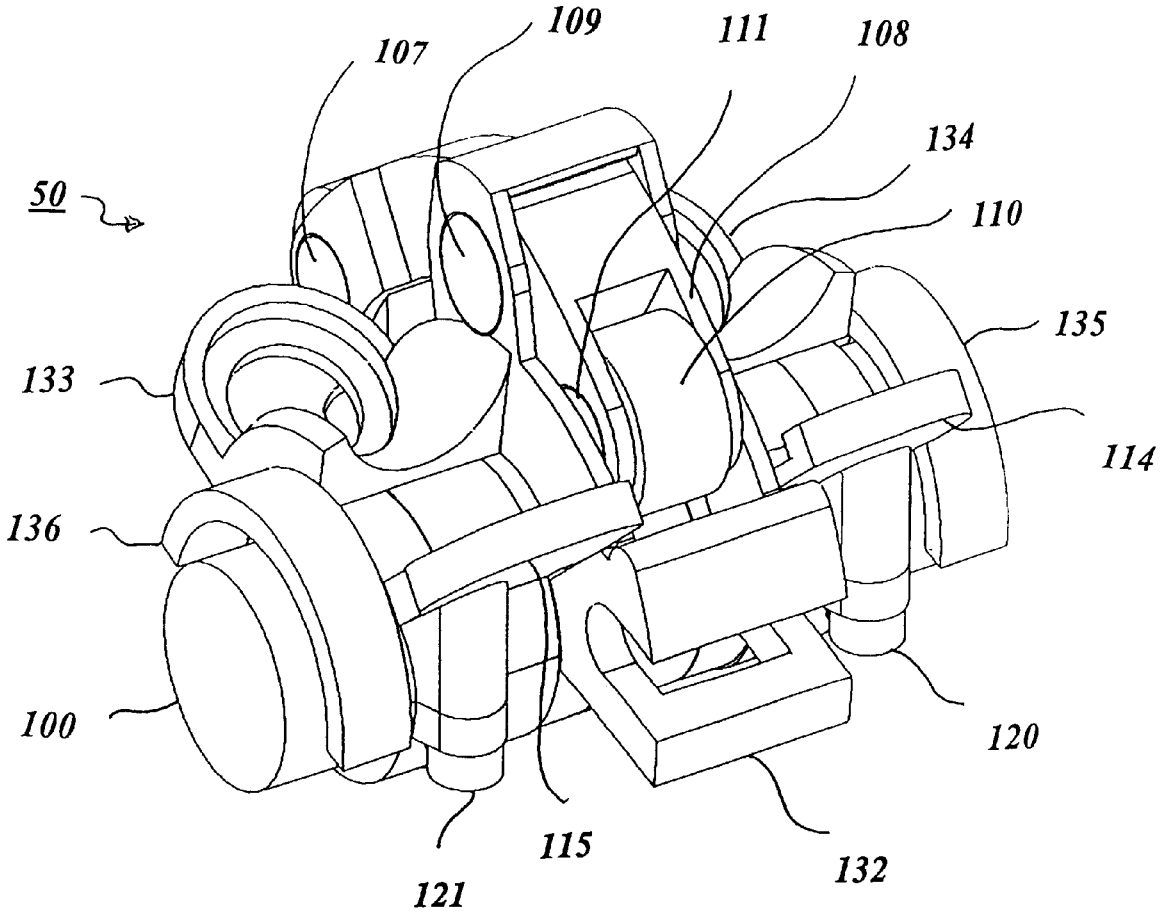
FIG. 6 is a rear view from slightly above the device with certain elements removed for clarity.

Motion of cam spring cups 114,115 about input camshaft 100 is resisted by curved helical compression springs 130, 131, depicted in FIG. 4, disposed between spring cups 114,115 and frame spring cups 133,134 (FIGS. 5 and 6) anchored to frame 132. These are return springs for reversing the action of the device during closing of the valves. When nose portion 104 of input cam lobe 102 reaches input roller 106, then rocker arm 108, bridge section 112, and output cams 116,117 all cease their clockwise motion. At this point, compression springs 130,131 are in full load position.

As clockwise rotation of input camshaft 100 continues, input roller 106 follows the closing flank 105 of input cam 102, causing counter-clockwise rotation of rocker arm 108, bridge section 112, and output cams 116,117. Torque exerted by compressed spring 130,131 between spring cups 133,134 and spring cups 114,115 forces bridge section 112 to stay in contact with output roller 110, while input roller 106 remains in contact with input cam lobe 102. Thus, compression springs 130,131 effectively remove all lash from output cams 116,117 back to input camshaft 100, thereby eliminating all lash in device 50.

With further clockwise rotation of input cam lobe 102, input roller 106 eventually reaches base circle portion 113 of input cam lobe 102. Bridge section 112, cam cups 114,115, and output cams 116,117 rotate counter clockwise until roller finger followers 124,125 reach base circle portion 123 of output cams 116,117, permitting valves 128,129 to close. The entire above sequence repeats with each revolution of input camshaft 100.

When one such device 50 is installed at each cylinder of an internal combustion engine 60, changes in the angular orientation of frame 132 by the actuation means (not shown but as referenced hereinabove) relative to the cylinder head permit engine load control to be achieved through the resultant phase change that occurs between the constant rotary motion of input cam lobe 102 and the oscillatory motion of output cams 116,117 and their respective profiles 122.

Rotating frame 132 counter-clockwise from the position shown in FIGS. 1 and 2 causes a reduction in valve lift and open duration, and an advance in the intake event. The output cams 116,117 are rotated counter-clockwise from the full load position, and the corresponding lift delivered to the finger followers 124,125 is reduced. The reduced lift arises from less of the output cam profiles 122 being utilized against followers 124,125 when nose portion 104 of input cam 102 reaches input roller 106. Correspondingly, the duration of the valve event is reduced as the finger followers spend more time on base circle 123 (no-lift zone) of the output cam lobes. Since rocker pivot pin 109 is also moved counter-clockwise as frame 132 moves counter-clockwise, input roller 106 is advanced relative to input cam lobe 102, the phase of which is unchanged with respect to the engine crankshaft. This advancing phase action causes the intake valves to close sooner in time as lift is reduced. The further the frame is rotated counter-clockwise, the further the lift and duration are decreased, and the further valve closing is advanced. Thus, the ingested charge mass of air/fuel mix and the resultant engine load are reduced.

Figure 3:
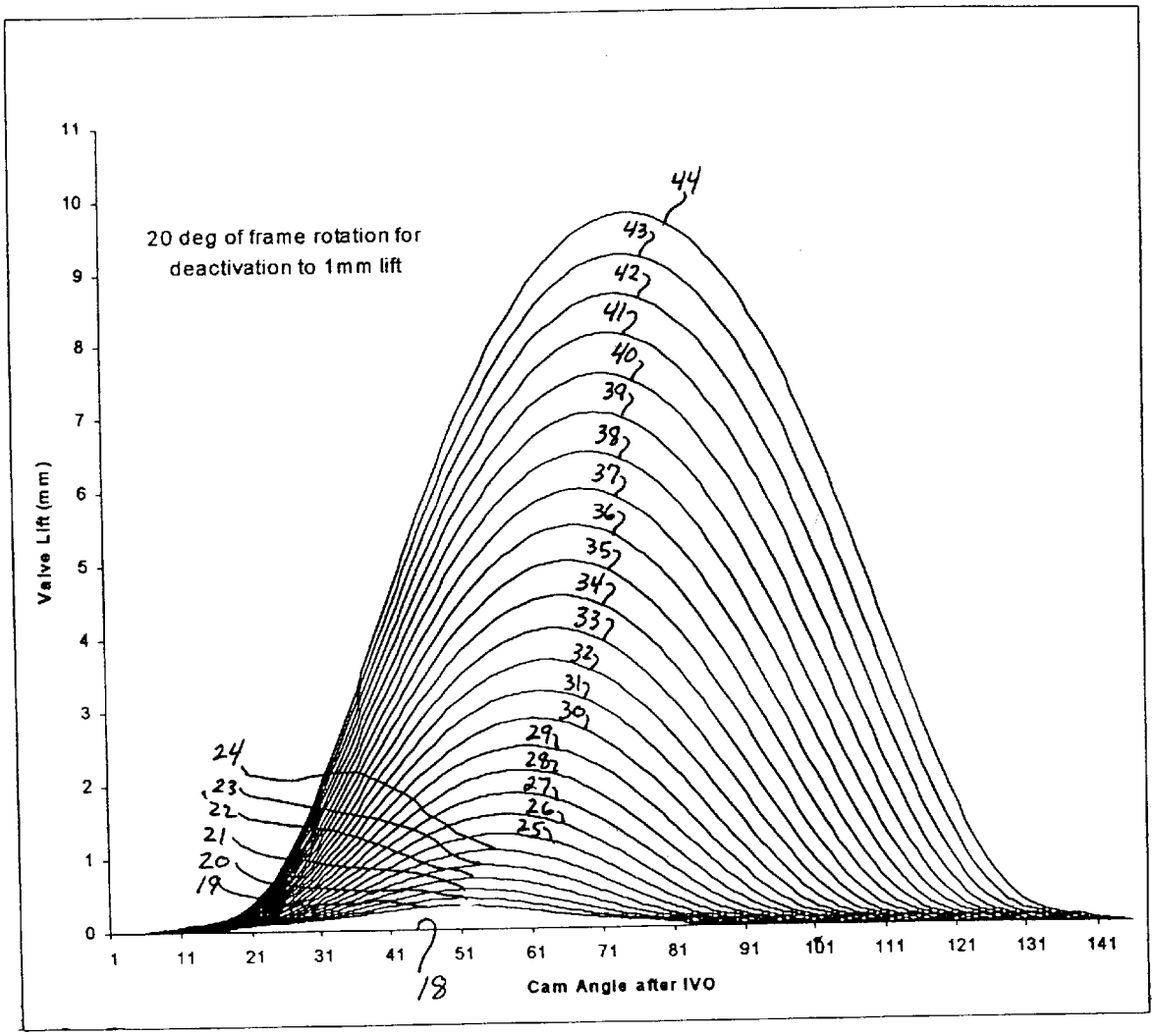
FIG. 3 is a graph showing exemplary intake lift curves (lift as a function of time, or output cam oscillation) as a result of various frame orientations of the apparatus about the engine camshaft.

Referring to FIG. 3, there is shown a graphical illustration of one possible family of valve timing and lift curves which could be obtained with a CR variable valve train device in accordance with the invention. Curves 18–44 represent valve lifts from "no lift" (curve 18) to "full lift" (curve 44) with full valve open time, which may be equivalent to the open period experience by a valve operated directly by a cam lobe as in a prior art engine. Intermediate curves 19–43 represent intermediate valve lifts and open periods ranging from only slightly open to nearly full open. The actual curves for any particular arrangement of device 50 would be dependent upon the dimensional characteristics of the device as determined during development of the particular device and its application to a specific internal combustion engine. Note that as the maximum lift (curve peak) is reduced, the input cam angle after initial valve opening (IVO) required to reach the peak is also reduced, i.e., the maximum lift is achieved earlier in the cam's rotation cycle, hence the timing is effectively advanced. Further, at lower lifts the duration of valve opening is also reduced. All of these features in combination are desirable for optimally controlling engine load, engine speed, and fuel economy.

It will be apparent to one of ordinary skill in the art that variable valve train device 50, as illustrated and described herein, and many of its features, could take various forms as applied to other applications and the like. If desired, the device of the invention could also be applied to the actuation of engine exhaust valves or other appropriate applications and the like.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A variable valve train device for cooperating with a camshaft, an input cam lobe of the camshaft, and the associated valve stem of a cylinder valve of an internal combustion engine to vary the lift of the valve, comprising:

a) a frame rotatably disposed on said camshaft;

b) a rocker arm rotatably mounted on said frame;

c) an input roller rotatably mounted on said rocker for followingly rolling on said input cam lobe;

d) a first spring receiving means attached to said frame;

e) a second spring receiving means rotatably disposed on said camshaft;

f) an output cam connected to said second spring receiving means for rotation therewith about said camshaft and for cooperating with said valve stem to cause said valve to be opened and closed;

g) an output roller rotatably mounted on said rocker arm for engaging and rotating said second spring receiving means and said output cam in response to corresponding rotary motion of said input cam lobe;

h) a spring disposed between said first and second spring receiving means for returning said rocker arm, said input and output rollers, said second spring receiving means, and said output cam to a starting position as said valve closes; and i) control means attached to said frame for controlling the angular orientation of said frame and components mounted thereupon with respect to said camshaft for controllably varying the lift of said valve as desired.

2. A device in accordance with claim 1 wherein said valve is a first valve for said cylinder and wherein said engine has first and second valves operating in parallel for said cylinder, further comprising:

a) a second set of components for opening and closing said second valve, said second components including another spring receiving means attached to said frame, another spring receiving means rotatably disposed on said camshaft, another output cam connected to said other spring receiving means for rotation therewith about said camshaft and for cooperating with said second valve to cause said second valve to be opened and closed, a second spring disposed between said other spring receiving means on said frame and said other spring receiving means on said camshaft for helping to return said rocker arm, said input and output rollers, said various spring receiving means, and said second output cam to a starting position as said second valve closes; and b) a bridge element connecting said two spring receiving means attached respectively to said first and second output cams for receiving said output roller on a surface thereof.

3. A device in accordance with claim 1 wherein said frame has an arcuate end extending longitudinally of said camshaft and wherein said device further comprises a camshaft bearing cap having an arcuate groove therein for receiving said arcuate end to permit rotation of said frame therein about said camshaft.

4. A device in accordance with claim 3 further comprising at least two such camshaft bearing caps.

5. A device in accordance with claim 1 wherein said spring is a curved, helical-shaped compression spring.

6. A device in accordance with claim 1 further comprising a roller finger follower disposed between said output cam and said stem of said valve for translating oscillatory motion of said output cam into axial motion of said valve stem.

7. A device in accordance with claim 6 wherein said roller finger follower is pivotably tethered to said engine at a first end thereof by a hydraulic lash adjuster and at a second end thereof to said valve stem.

8. An internal combustion engine having a plurality of independent cylinders, and a plurality of intake valves opening upon said cylinders, said intake valves being operated by a plurality of input cam lobes disposed upon at least one camshaft, wherein each of said cylinders is provided with a variable valve train device for cooperating with the camshaft, the input cam lobes of the camshaft, and the associated valve stems of the cylinder valves to vary the lift of the valves, each of said devices comprising:

a) a frame rotatably disposed on said camshaft;

b) a rocker arm rotatably mounted on said frame;

c) an input roller rotatably mounted on said rocker for followingly rolling on said input cam lobe;

d) a first spring receiving means attached to said frame;

e) a second spring receiving means rotatably disposed on said camshaft;

f) an output cam connected to said second spring receiving means for rotation therewith about said camshaft and for cooperating with said valve stem to cause said valve to be opened and closed;

g) an output roller rotatably mounted on said rocker arm for engaging and rotating said second spring receiving means and said output cam in response to corresponding rotary motion of said input cam lobe;

h) a compressible spring disposed between said first and second spring receiving means for returning said rocker arm, said input and output rollers, said second spring receiving means, and said output cam to a starting position as said valve closes; and i) control means attached to said frame for controlling the angular orientation of said frame and components mounted thereupon with respect to said camshaft for controllably varying the lift of said valves as desired.

9. A method for variably controlling the lift, duration of opening, and operational timing of a valve with respect to the motion of a piston in an internal combustion engine to control the rotational speed and load of the engine, comprising the steps of:

a) providing a variable valve train device for cooperating with a camshaft and an input cam lobe of said camshaft and the associated valve stem of said valve, including i) a frame rotatably disposed on said camshaft, ii) a rocker arm rotatably mounted on said frame, iii) an input roller rotatably mounted on said rocker for followingly rolling on said input cam lobe, iv) a first spring receiving means attached to said frame, v) a second spring receiving means rotatably disposed on said camshaft, vi) an output cam connected to said second spring receiving means for rotation therewith about said camshaft and for cooperating with said valve stem to cause said valve to be opened and closed, vii) an output roller rotatably mounted on said rocker arm for engaging and rotating said second spring receiving means and said output cam in response to corresponding rotary motion of said input cam lobe, viii) a spring disposed between said first and second spring receiving means for returning said rocker arm, said input and output rollers, said second spring receiving means, and said output cam to a starting position as said valve closes, and ix) control means attached to said frame for controlling the angular orientation of said frame and components mounted thereupon with respect to said camshaft; and b) varying said control means to change said angular orientation of said frame and components as desired to increase or decrease the lift of said valve and to advance or retard the timing of opening and closing of said valve and to increase or decrease the duration of opening of said valve, thereby controlling the rotational speed and load of the engine.

* * * * *